US009434152B2

(12) United States Patent
Williams et al.

(10) Patent No.: US 9,434,152 B2
(45) Date of Patent: Sep. 6, 2016

(54) METHOD AND APPARATUS FOR A CARBON FIBER PRINTING PRESS ROLLER WITH A NYLON OR CHROME OUTER SURFACE

(71) Applicants: Joe Kelly Williams, Hurst, TX (US); Michael Piontek, Chicago, IL (US)

(72) Inventors: Joe Kelly Williams, Hurst, TX (US); Michael Piontek, Chicago, IL (US)

(73) Assignee: Rotation Dynamics Corporation, Darien, IL (US)

( * ) Notice: Subject to any disclaimer, the term of this patent is extended or adjusted under 35 U.S.C. 154(b) by 381 days.

(21) Appl. No.: 13/728,023

(22) Filed: Dec. 27, 2012

(65) Prior Publication Data

US 2014/0182468 A1 Jul. 3, 2014

Related U.S. Application Data

(60) Provisional application No. 61/631,208, filed on Dec. 29, 2011.

(51) Int. Cl.

| | |
|---|---|
| ***B41F 3/26*** | (2006.01) |
| ***B41F 7/26*** | (2006.01) |
| ***B65H 27/00*** | (2006.01) |
| ***B41J 13/076*** | (2006.01) |
| ***B41F 31/26*** | (2006.01) |
| ***B41N 7/04*** | (2006.01) |
| ***B41N 7/06*** | (2006.01) |

(52) U.S. Cl.

CPC ..... *B41F 31/26* (2013.01); *B41F 7/26* (2013.01); *B41N 7/04* (2013.01); *B41N 7/06* (2013.01); *B41J 13/076* (2013.01); *B41N 2207/02* (2013.01); *B41N 2207/06* (2013.01); *B41N 2207/10* (2013.01); *B65H 27/00* (2013.01)

(58) Field of Classification Search

CPC ..... B65H 27/00; B41J 13/076; B05D 5/04; B05D 2254/02; B05D 7/52; B41F 31/26

See application file for complete search history.

(56) References Cited

U.S. PATENT DOCUMENTS

| | | | | |
|---|---|---|---|---|
| 5,061,533 | A * | 10/1991 | Gomi et al. | 428/36.3 |
| 5,660,109 | A * | 8/1997 | Constantino et al. | 101/348 |
| 2004/0127122 | A1* | 7/2004 | Davenport et al. | 442/64 |
| 2008/0248210 | A1* | 10/2008 | Kondos et al. | 427/412.1 |
| 2009/0301326 | A1* | 12/2009 | Barr et al. | 101/328 |
| 2011/0136638 | A1* | 6/2011 | Sumiyoshi | 492/48 |

* cited by examiner

*Primary Examiner* — John Fitzgerald
*Assistant Examiner* — John M Royston
(74) *Attorney, Agent, or Firm* — Pyle & Piontek, LLC

(57) ABSTRACT

A carbon fiber roller core coated or covered with an outer nylon or outer chrome surface for use in a printing press, and a method of making and the method of using same are disclosed. The advantages of a light weight roller for shipment, handling and roller replacement are provided. Also the desired nylon or chrome surface for use in the printing press, such as the press inking or water system is also provided.

20 Claims, 6 Drawing Sheets

Fig. 2
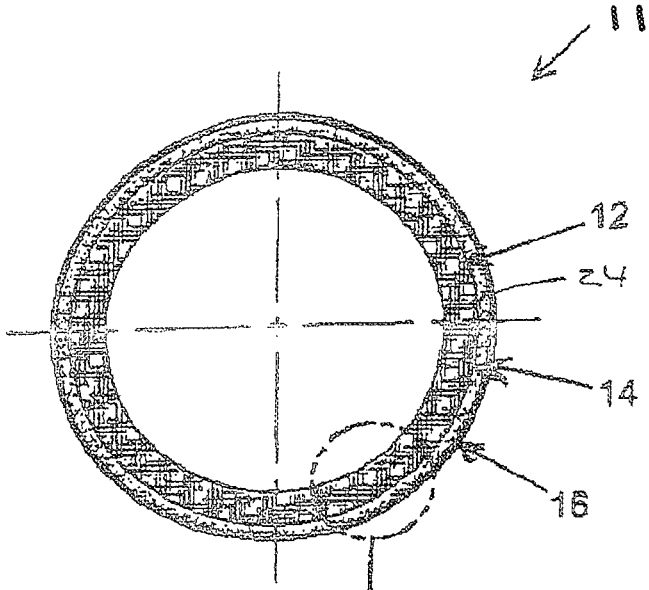
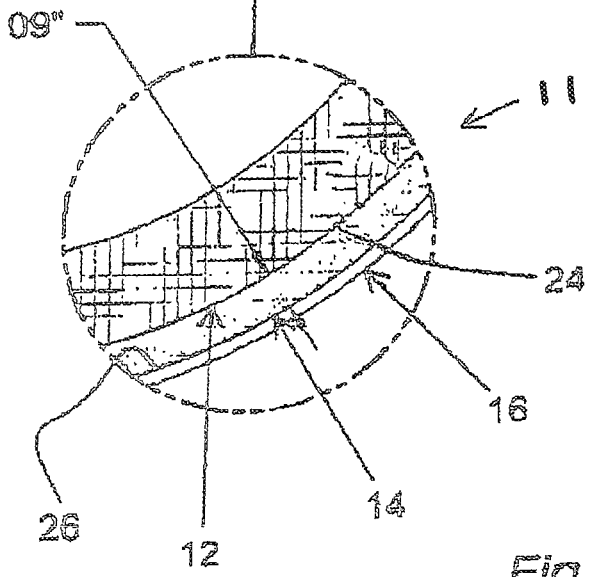
Fig. 3

| Upper Unit | Cover |
|---|---|
| 1. Ink Fountain Roller | Steel |
| 2. Ink Meter Roller | Nylon |
| 3. Ink Transfer Roller | Rubber |
| 4. Ink Transfer Roller | Rubber |
| 5. Ink Transfer Roller | Rubber |
| 6. Ink Vibrator Roller | Nylon |
| 3. Ink Form Roller | Rubber |
| 5. Ink Form Roller | Rubber |
| 7. Water Form Roller | Rubber |
| 8. Chrome Vibrator Roller | Chrome |
| 9. Brush Roller | Brush |
| 10. Pan Roller | Chrome |

| Lower Unit | Cover |
|---|---|
| 1. Ink Fountain Roller | Steel |
| 2. Ink Meter Roller | Nylon |
| 3. Ink Transfer Roller | Rubber |
| 4. Ink Transfer Roller | Rubber |
| 5. Ink Transfer Roller | Rubber |
| 6. Ink Vibrator Roller | Nylon |
| 3. Ink Form Roller | Rubber |
| 5. Ink Form Roller | Rubber |
| 7. Brush Roller | Brush |
| 8. Chrome Vibrator Roller | Chrome |
| 9. Water Form Roller | Rubber |
| 10. Water Pan Roller | Chrome |

Paper runs and is printed between upper and lower blanket cylinders.

Fig. 8

METHOD AND APPARATUS FOR A CARBON FIBER PRINTING PRESS ROLLER WITH A NYLON OR CHROME OUTER SURFACE

DISCLOSURE

This application is a United States non-provisional application claiming the benefit and filing date of U.S. Provisional Application of the same title, Ser. No. 61/631,208, filed Dec. 29, 2011 and relates to an apparatus and method of making and using a printing press roller, and more particularly, a carbon fiber printing press roller with an outer nylon or chrome surface thereon.

BACKGROUND OF THE INVENTION

Because the speed of web offset printing presses has continued to increase (web speeds can exceed 4200 ft/min.), manufacturers of printing presses have continued to search for ways to reduce the rotating mass of the rollers in the presses. One way this is accomplished is by using carbon-fiber cores for the rollers of the printing press, which can reduce the weight of the rotating mass considerably and at least up to approximately 85% when compared to using steel rollers.

In for example, an offset printing press, there are basically three materials that are presently applied to the surface of a metal or steel roller core: rubber, nylon or chrome.

Other known disadvantages of a metal or steel core roller include the difficulty of replacement of such rollers which can exceed seven feet in length, can be very heavy and may cause injuries, such as crushed fingers, of those doing the replacing of a roller in a printing press.

Heretofore, it has been known to provide metal, usually made of steel, printing press rollers have an outer coating of nylon or chrome applied thereto. These steel rollers with nylon or chrome outer surfaces were usually used in the press inking system. However, no such nylon or chrome outer coatings have been known to been successfully applied to carbon fiber rollers. It is known that a roller made of carbon fiber would be lighter in weight, stiffer, and more easily handled than would be a steel roller. It is known to use such carbon fiber rollers in presses, but without a nylon or chrome outer surface thereon. Such prior art carbon fiber rollers have had usually a rubber outer surface thereon. The outer surface of the carbon fiber roller, itself, does not possess the necessary properties or attributes to work successfully in a printing press, and particularly in the inking system, where heretofore nylon or chrome outer coated steel rollers were used. For example, in the inking and water systems of certain types of presses, a nylon or chrome surface is needed. Heretofore, it has not been possible to successfully put such nylon or chrome outer surface onto a carbon fiber roller core.

In the conventional method for coating a metal steel core rollers with nylon, a fluidized bed, is a preferred method of applying powders, such as nylon, to a metallic surface. In this process the steel roller to be nylon coated is first heat sunk for a predetermined period of time in an oven, correlated to core size/mass, to reach a temperature of approximately 550° F. The hot metallic roller is then removed from the heating oven and rotated in a fixture inside the fluidized bed until the nylon melts onto and coats the metal core, to the proper thickness. Such procedure will not work with a carbon fiber roller core as such heating would also destroy the carbon fiber core.

Similarly a chrome surface can be provided onto a metal or steel roller by conventional plating it onto the steel roller directly or indirectly with intervening layers of copper and/or nickel.

SUMMARY OF THE INVENTION

This disclosure involves the novel application and applying of nylon or chrome to the outer surfaces of carbon fiber cores rollers, decreasing the weight of the finally formed roller while providing the desired or needed outer nylon or chrome surface to work in printing presses where such surfaces are required.

According to the invention there is provided a carbon fiber nylon or chrome roller, a method for making and providing on, and method for using a nylon or chrome coated carbon fiber printing press roller, and also the carbon fiber nylon or chrome coated roller provided by the methods hereof. In the present invention, the roller body is made of carbon fiber upon which outer surface is provided a nylon or chrome coating or surface. The present invention includes methods of making and using such nylon or chrome coated carbon fiber roller in the printing industries (in for example, offset, flexo, or rotogravure presses and processes).

The carbon fiber nylon or chrome coated roller of the apparatus and methods of the present invention provides the desired light weight and handling ease of a carbon fiber roller but also the desired surface characteristics of a nylon or chrome coated roller. A carbon fiber roller of the present invention would have about 85% or more of the weight of a steel roller it would replace removed, and would weigh about 15% or less than a steel roller it would replace.

The present invention carbon fiber roller have low weight and great stiffness, are coated to assure that they are without defect about the circumference thereof, also provide the desired outer surface properties, and can be recoating with nylon or chrome on occasion increasing the overall useful life of the roller of the present invention.

In the application of nylon to carbon fiber roller cores, an obstacle to be overcome is the temperature of the core typically involved in prior techniques used in the application of powdered nylon onto the prior art steel surface. As noted above, with a steel core roller, it is heated to a temperature of approximately 500° F. so that the nylon powder can be applied in a fluidized bed. Such process of heating the core to a high temperature can not be used with a carbon fiber roller core as at that heat and temperature would damage the carbon fiber roller core.

In the present invention, to avoid thermal destruction of the epoxy or other resins or binders used to manufacture carbon fiber roller cores, the nylon may be applied by thermal powder spray; while limiting the surface temperature on the carbon fiber roller core to 260° F. or less. The temperature of the application is monitored, for example by using one or more optical pyrometers to measure actual maximum core surface temperature produced during the process at points, preferably both, upstream and downstream of the point of application of the thermal powder nylon spray which creates the coating.

Preferably, the carbon fiber roller comprises a carbon fiber core, with a first covering of epoxy approximately ⅛ inch thick thereon which allows for thermal expansion, which epoxy covering is applied using heat and/or compression, such as for example by wrapping a carbon fiber epoxy coated tape tightly onto the core under tension (providing compression) and cured using heat. Thereafter, the nylon is then applied over this initial epoxy coating by spraying at approximately the same and sufficient thickness as typically provided on a metal core roller and then finished to desired diametric size and surface finish. For example, the thickness of the nylon is about from 0.25 to 0.100 inches, with 0.35 to 0.06 inches being preferred.

The bond between the nylon coating, intermediate epoxy cover and the carbon fiber core using the method of the present invention is at least above 1500 psi, preferably about 1600 psi or higher, and equal to or greater than the bond strength between a conventional nylon coating on a metal (steel) roller core surface. Such nylon coated carbon fiber rollers can be used in printing presses to replace rollers in the inking or water system, such as, for example, the ink meter roller, ink vibrator roller, and/or ink transfer roller.

In the application of chrome to the outer surface of a carbon fiber roller an obstacle to be overcome is the provision of the surfaces on the carbon fiber roller which can receive the chrome final outer surfaces. A conventional carbon fiber roller core can not be plated directly as it may not be electrically conductive as the epoxy resin therein acts as an insulator.

In the present invention one way to overcome this characteristic would be to form the core of a conductive carbon and then that conductive carbon material be exposed, as by machining or grinding.

Another approach would be to include metallic or electrically conductive material in the core itself or a surface formed on the core, such as by an epoxy and metallic mixture and then exposing as by machining or grinding the conductive or metallic material to expose the same.

Yet another approach would be to bond or press a thin metallic or electrically conductive cylindrical sleeve onto the carbon fiber core roller.

Once the metallic or electrically conductive outer surface is provided on the carbon fiber roller, then the final outer chrome surface may be provided thereon to form the carbon fiber core chrome outer surface roller by conventional plating processes.

The formed carbon fiber core chrome outer surface roller may then be used in a printing press in the positions the prior art steel chrome rollers were used, such as in the water and ink systems. A printing press can be provided with one or more carbon fiber core chrome or nylon outer surfaced rollers, particularly in the ink and water systems of such press.

BRIEF DESCRIPTION OF THE DRAWINGS

FIG. 2 is a cross sectional view through the carbon fiber roller with core coated with nylon by the apparatus and method shown in FIG. 1.

FIG. 3 is an enlarged view of a portion of the cross sectional view of FIG. 2 and shows the carbon fiber roller core, with an intermediate epoxy layer thereover which helps hold the outer nylon coating in place on the surface of the roller.

FIG. 7 is a schematic view showing the various rollers in a typical printing press including water and inking systems in which the nylon coated or chrome coated carbon fiber core of the present invention could be utilized.

FIG. 8 provides a cross reference listing of the rollers and their surfaces of the typical printing press shown in FIG. 7.

DESCRIPTION OF THE PREFERRED EMBODIMENTS

Figure 1:
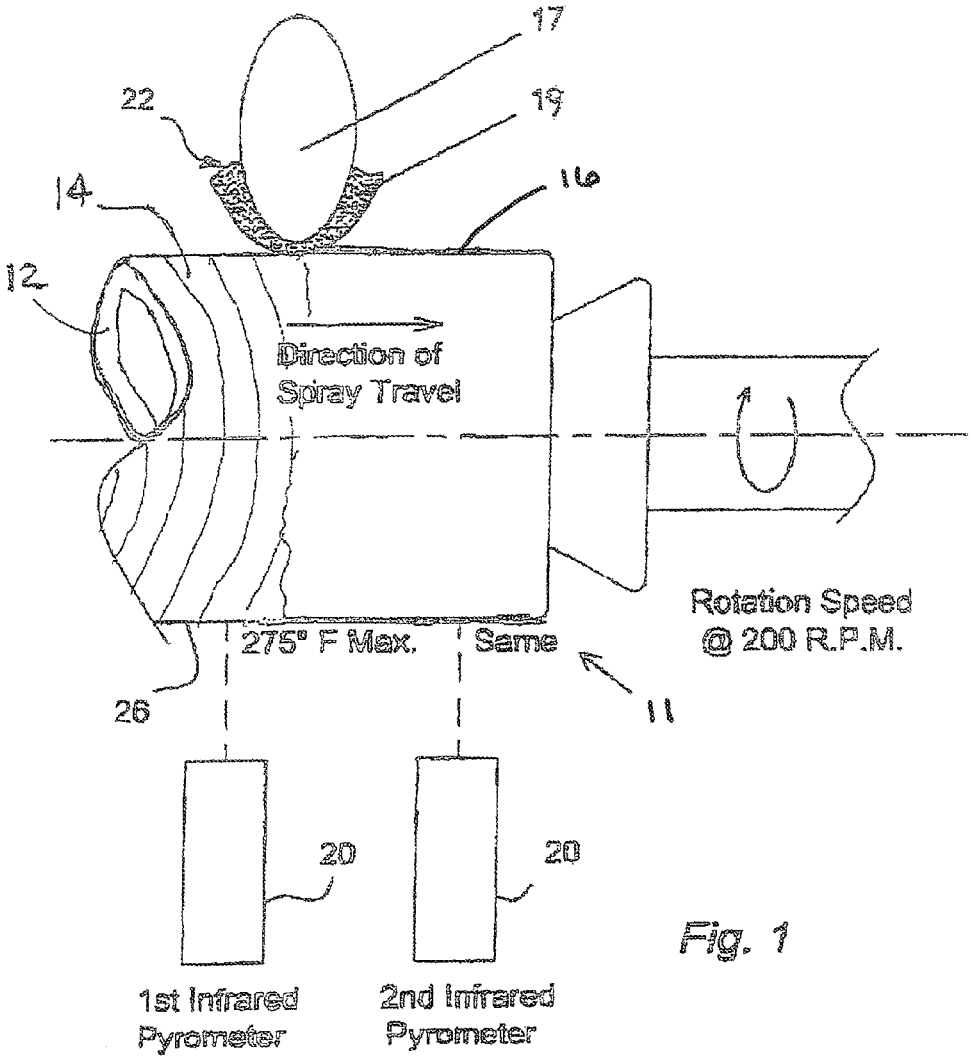
FIG. 1 is a schematic view illustrating one type of apparatus to carry out the method of the present invention for forming and/or coating a carbon fiber roller core with an outer coating of nylon to form a roller of the present invention.

Referring now to FIGS. 1 to 3 there is illustrated therein in greater detail a nylon coated carbon fiber roller 11 (being formed in FIG. 1 and shown in FIGS. 2 and 3) for use in, for example, a printing press 13 (FIGS. 7 and 8), made in accordance with the teachings of the present invention. The roller 11 has a carbon fiber core (carbon fibers bonded with a binder, usually an epoxy) 12 which on its outer surface is to be coated with nylon or, as later discussed herein, chrome, in accordance with the methods of the present invention. For example, the carbon fiber roller core 12 used in the method can be a standard ⅜ inch wall thickness carbon fiber core, with an intermediate highly epoxy saturated carbon fiber tape over wrap or cover 14 that is, for example, approximately 0.09 inch thick of high temperature epoxy which is applied through use of heat and/or compression. Such high temperature epoxy in cover 14, has been found, can withstand a temperature of up to about 275° F. without deteriorating.

This cover 14 or layer of epoxy serves as an insulator that maintains the integrity of the inner carbon fiber core 12 intact during a subsequent thermal spraying on of an outer nylon coating layer 16.

During development of the method for applying the nylon coating 16 on to carbon fiber cores 12 two things were paramount:

1. minimize to an acceptable level the thermal absorption within the carbon fiber core 12, and especially keep it to the acceptable level in the epoxy binding cover layer 14 for fixing the thermal nylon coating 16 to the carbon fiber core 12.

2. develop high integrity bonds between the nylon coating 16 layer, the epoxy bonding cover 14 layer and the carbon fiber core 12.

In the present invention, the carbon fiber core 12 is made using carbon fiber originally using high temperature epoxy which can withstand about 275° F. This core is then covered or wrapped tightly with the epoxy tape 14 tape to provide some compression and then heat cured. If this thus far assembled roller were heat sunk to high temperatures as was done with prior art steel rollers, it would destroy the epoxy core and epoxy cover 14 layer, rendering the material(s) useless. Instead, the carbon fiber epoxy covered roller core 12 is heated in a very controlled manner not to exceed or reach a destructive temperature.

Instead of the heat sunk method of prior art, a thermal spraying of the nylon coating 16 layer onto the carbon fiber roller core or body 12 is utilized; using a spray system (schematically shown at 17 combining high pressure gas, such as propane, as fuel, and high pressure oxygen to feed the fuel and accelerate the nylon powder used to create the outer nylon coating 16 layer on the inner epoxy insulating coating 14.

Using this methodology, the center of the flame or plume (flame feather) is hotter than the outer limits of the spray 19 of nylon forming the coating 16 and hot enough to work, while maintaining the epoxy cover 14 layer on the surface of and the carbon fiber core 12 at a safe temperature of 260° F. or below.

In using this method, it is believed there is no limitation to the thickness of the sprayed nylon coating 16 that could be applied to the core, except those of time and cost. The nylon coating 16 layer applied was a thickness of approximately 0.197 inches.

Two different nylon materials were sprayed onto separate carbon fiber cores 12, both were (type 11) powders, produced by Arkema, Inc. of Philadelphia, Pa. One utilized was a black nylon powder material known as Rilsan® black HVRXFB, which was 99% polyamide (type 11) (CAS#25587-80-8) and 1% carbon black. A second type used was a gray material known as Rilsan®6151 grey FBHV2 which was 96% polyamide and 4% titanium dioxide (for color).

Using the spray system 17 for application of the nylon coating 16 allowed for use of a optical pyrometer, and preferably two pyrometers 20 with an infrared guide to check surface temperatures immediately upstream and downstream of the point of contact or application of the nylon spray 19 and the carrying plume 22 with the epoxy covered 14 carbon fiber core 12. The epoxy cover 14 utilized in testing was a higher temperature material with a heat sink capability of 275° F. Therefore the exposure limit was set to 260° F. The nylon used melts at about 310° F.-320° F. The pyrometers 20 and detected temperatures were monitored to ensure maintained surface integrity of the carbon fiber core 12 and epoxy substrate 14.

Using thermal foot spraying, it is possible to spray to size to produce a finished product eventually meeting required mechanical specifications for straightness, flatness and total indicated runout (T.I.R.). Though spraying without tight controls and subsequent machining to about final size and then polishing, if needed, is still less time consuming. For example, it takes about twice as long or so to spray to size as it does to rough spray to oversize them turn to size so equipment time and labor costs for the former are higher.

Now the applied heated nylon 16 cools and will eventually absorb moisture. The time to re-absorb moisture in the nylon takes about 6-12 hours. The applied nylon re-absorbs 1%-1½% moisture to about what nylon would absorb regardless of core material.

A procedure for making a nylon carbon fiber roller 10 of the present invention is set forth in additional detail below.

As noted, a completed roller 11 comprising an outer nylon 16 on a coated carbon fiber core 12. In the initial steps, the carbon fiber core 12 is first turned in a lathe to clean it up. The core 12 is next checked for integrity, defined as being devoid of de-laminations, voids, such as pin holes, foreign material and imperfections in the surface topography. The core 12 is then again turned on the lathe to a predetermined prefinished under size, preferably 0.050-0.060 inch smaller in diameter than the required finished size, as many size variations exist in the industry, and to a surface finish or roughness of about 125 microns root means square (R.M.S.).

The core 12 is next cleaned using acetone or other solvent, and its exterior surface is then sand blasted using fine blast media and low air pressure (30-50 lb/sq. in.) to achieve a surface finish of 500-700 R.M.S. Such surface finish will increase bonding between the epoxy cover 14 layer to be applied onto the outer surface 24 of the core 12.

Next the intermediate epoxy layer 14 is applied or wrapper onto the core 12. The carbon fiber tape is saturated with high temperature epoxy, tightly wrapped onto the core 12 and then heat applied to cure the tape or epoxy layer 14 onto the core 12.

Using a Universal Thermal Spray System 17, thermal nylon powders 19 are sprayed onto the epoxy tape or cover 14 and bonded to the exterior surface 26 of the tape or intermediate layer 14 on the carbon fiber core 12. To maintain temperatures on the epoxy covered outer surface 26 at or below approximately 260° F., one or more pyrometers 20 are utilized to check temperatures just ahead of and behind the spray plume 22 applied by the spray system 17 until a nylon coating 16 of a desired thickness, such as approximately 0.070 inches, has been built up and applied.

After application of the nylon coating 16 spray on layer, the carbon fiber core 12 with the epoxy cover 14 and nylon coating 16 is cooled for approximately 3 hours, and the outer surface of the nylon coating 16 applied is inspected to assure it is within acceptable limits.

The completed roller 11, including carbon fiber core 12, and its outer nylon coating 16 is then lathe turned to a desired dimension and polished to a 63+ or −2 R.M.S. finish, (being allowed an 0.005 inch oversize for final polishing) to an 8+ or −1 R.M.S. final finish.

The finished, nylon coated carbon fiber core roller 11 is then cleaned, finally inspected to make sure it is within acceptable limits, and is ready to be packed, shipped and then installed in a customer's printing press.

A small section of the nylon coated 16 carbon fiber core roller 11 was cut into sections and tested for bond verification. It was found that the bond between the carbon fiber core 12 and nylon coating 16 attached thereto using an intermediate epoxy interface 14 was judged to be over 1,600 lbs. per in$^2$ and approximately 1,605 lbs per in$^2$. This bond measurement was equal to or greater than the approximately 1500 lbs per in$^2$ achieved for coated nylon on steel cores in a conventional nylon steel roller.

Referring to FIGS. 7 and 8, in a printing press assembly 13, schematically shown the nylon coated carbon fiber core roller 11 of appropriate size may be utilized in a plurality of positions within the press assembly 13, each of which is schematically illustrated in FIG. 7 and given in a number cross reference (1 to 10) in FIG. 8.

As the method for forming and using and the apparatus of a carbon fiber nylon coated roller has been described, now those for the carbon fiber chrome coated roller 11' will now be described in connection to FIGS. 5, 6, 7, and 8.

Generally the carbon fiber core, which may be similar to core 12, is provided with a final outer chrome surface 16'. To this end the carbon fiber core 12, may first be provided with a metallic and/or electrically conductive surface, such as by 1. pressing or bonding a metal sleeve (to form 14') onto the core 12
2. forming an electrically conductive surface 14' itself on the core 12
3. forming a metallic surface or partial surface 14' on the core 12, as for by example, including metallic (electrically conductive) material on the surface of the core 12. Such metallic electrically conductive material could be applied in or to the core then that material turned or ground to expose the metallic (electrically conductive) material
4. plating a metallic surface 16' onto a core 12, which itself is sufficiently electrically conductive to be plated Alternatively if method "1." is used, the chrome plating could be applied to the sleeve 14 and then the chromed sleeve put on and finished on the core to size and polish. A further alternative would be to chrome plate the sleeve and finish it to its final form and then affix the finished chromed sleeve onto the core 12.

Figure 4:
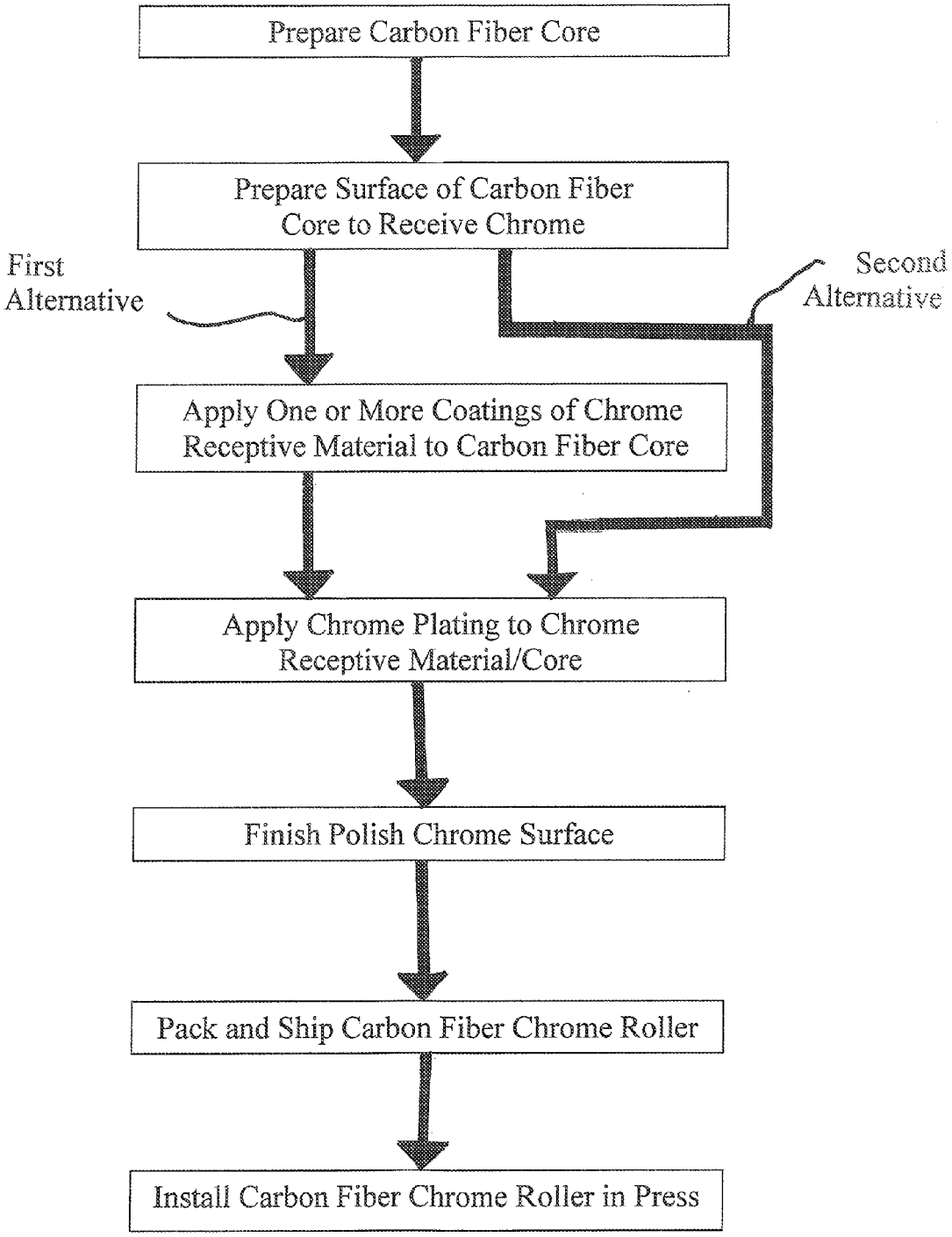
FIG. 4 is a flow chart for forming a chrome, instead of nylon, surface or coating on the carbon fiber roller core.
Figures 5, 6:
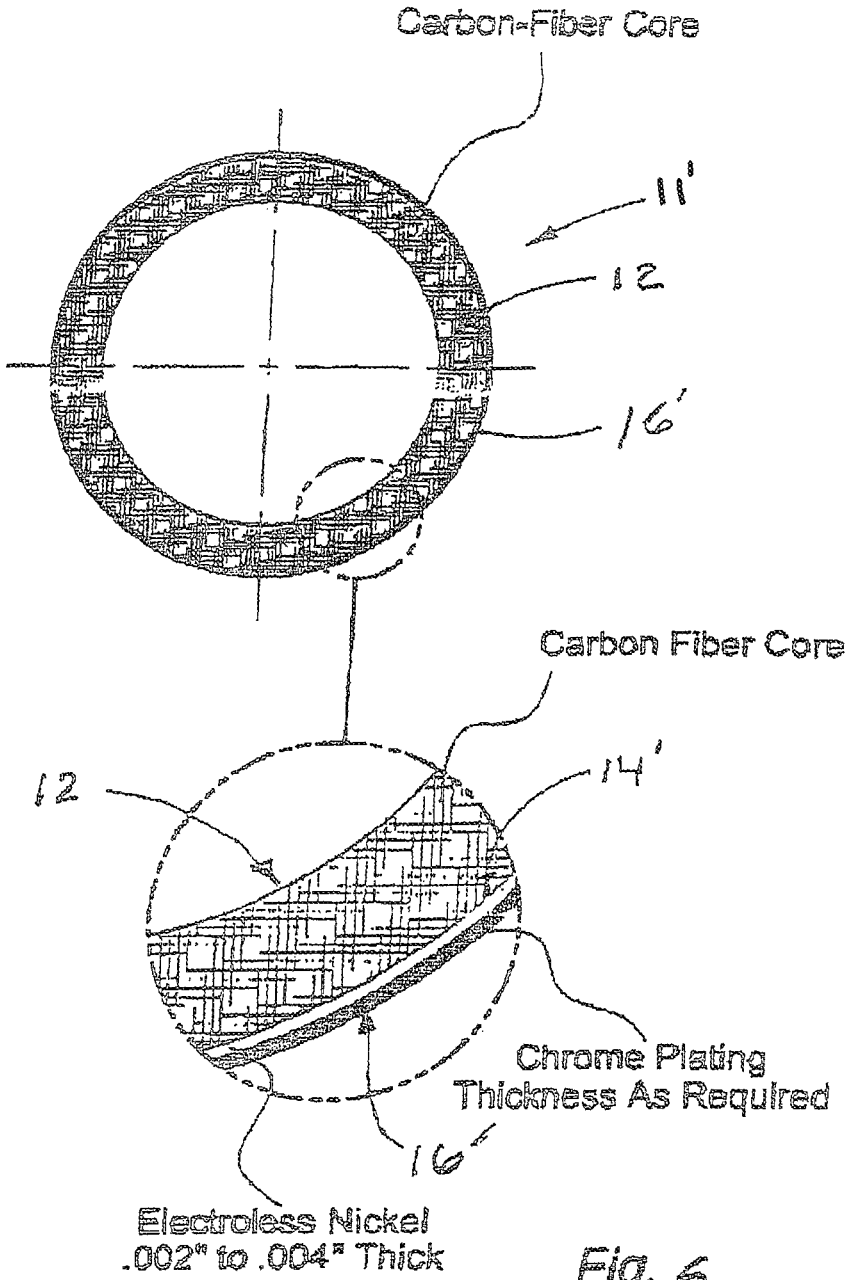
FIG. 5 is a cross sectional view through the carbon fiber roller core with a chrome coating outer surface thereon.
FIG. 6 is an enlarged view of a portion of FIG. 5 showing the chrome outer surface on the carbon fiber roller core.
Figure 1:
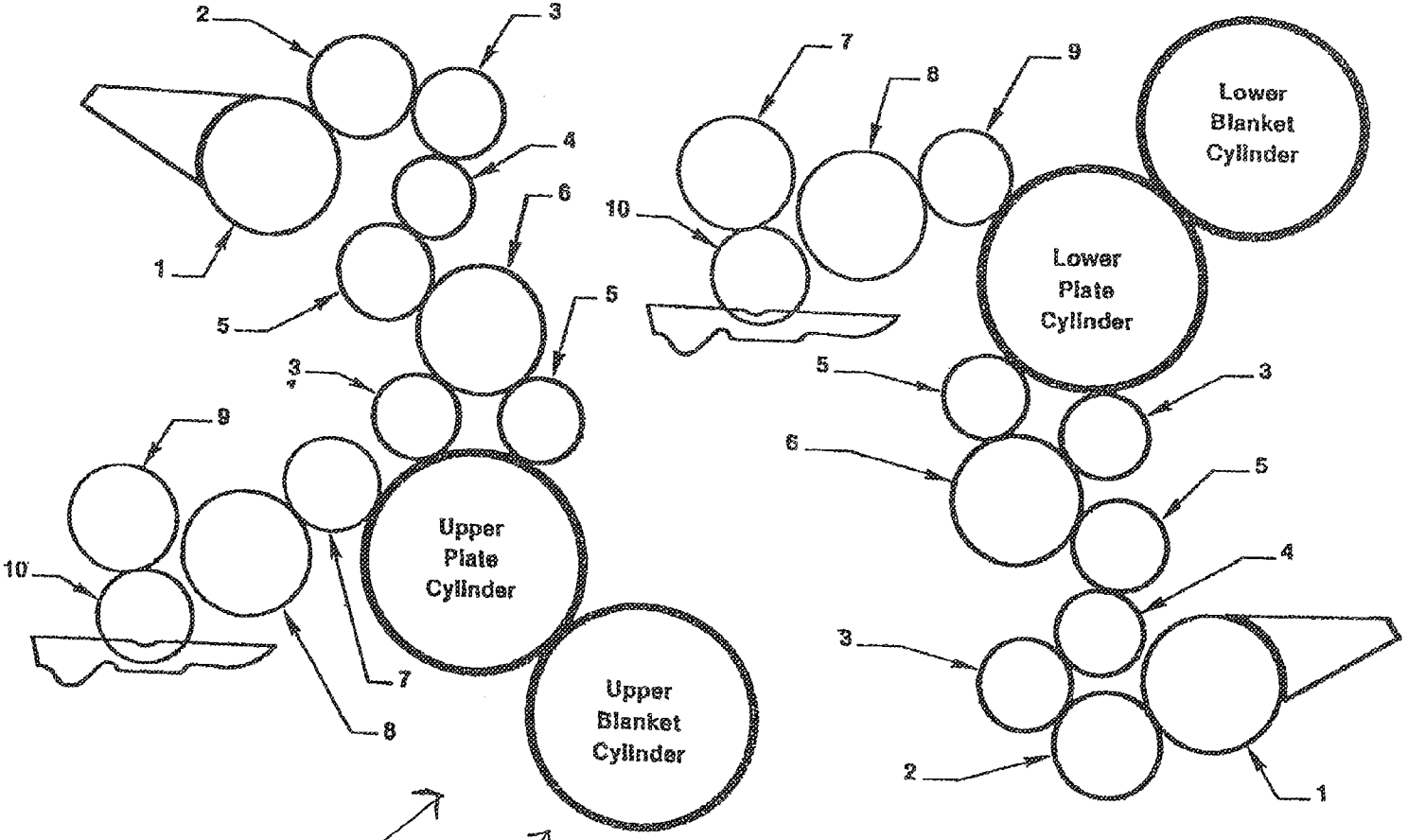

After a suitable material 14' is provided on the core outer surface 12, outer surface of material 14' may then be chrome plated, directly (see first alternative FIG. 4) or indirectly (with first one or more copper or nickel surfaces first be plated thereon (see second alternative FIG. 4)), before the final chrome plating is applied.

The plating process can be any one of the heretofore used chrome plating processes after it is established that the carbon fiber core is first made plateable. The plating procedures and thicknesses may be similar to that previously used heretofore with conventional steel roller chrome plated rollers. Such would typically have about 0.004 inches electro-less nickel, about 0.006 inches copper and about 0.012-0.014 inches chrome on the outside diameter. Electro-less nickel was developed in the [30's] 1930s before World War Two. Using an ionic bath, the plating of the nickel occurs thru chemical reduction and not ionic displacement. This process requires no electrical energy and for that reason just about anything that will not be damaged by temperatures of 250° F. can be plated. It is most commonly used in aerospace manufacturing.

The carbon fiber chrome plated rollers 11' of and made by the method of the present invention can be used in a press for example in the chrome positions shown in FIG. 7 and referenced in FIG. 8.

While preferred embodiments and method or processes of the present invention have been illustrated and described and variations thereof have also been disclosed or described, equivalent elements and equivalent steps thereof all fall within the present invention, and also the scope of the attached claims.

What is claimed is:

1. A method for creating a carbon fiber roller core for use in a printing press to provide an outer surface thereon suitable for use therein, comprising the steps of:
- obtaining a carbon fiber roller core,
- checking the carbon fiber roller core for defects,
- applying an intermediate covering to the carbon fiber roller core, and
- applying a desired nylon outer coating to the outer surface of the intermediate covering,
  - wherein said step of applying said desired outer coating is spraying a nylon, and
  - whereby the formed carbon fiber roller core with the intermediate covering and desired nylon outer coating can be used in the printing press.

2. A method for creating a carbon fiber roller core for use in a printing press to provide an outer surface thereon suitable for use therein, comprising the steps of:
- obtaining a carbon fiber roller core,
- checking the carbon fiber roller core for defects,
- applying an intermediate covering to the carbon fiber roller core;
- wherein said step of applying said intermediate coating is applying an epoxy onto said carbon fiber roller core;
- applying a desired nylon outer coating to the outer surface of the intermediate covering; and
- wherein said step of applying said desired outer coating is spraying a nylon; and
- whereby the formed carbon fiber roller core with the intermediate covering and desired nylon outer coating can be used in the printing press.

3. The method as in claim 2, comprising the steps of:
- (a) beginning with said carbon fiber roller core having of a first configuration,
- (b) turning said carbon fiber roller core to a second undersized configuration,
- (c) checking the turned carbon fiber roller core for defects,
- (d) heating the carbon fiber roller core with said high temperature epoxy covering thereon to a desired temperature to make said high temperature epoxy covering receptive to receive said nylon coating without thermally damaging either the high temperature epoxy an/or carbon fiber roller core,
- (e) spraying the nylon coating onto the epoxy covering on the carbon fiber roller core, and
- (f) finishing the nylon coating on the carbon fiber roller core to the desired size for use in said printing press.

4. The method as in claim 2, comprising the steps of:
- beginning with said carbon fiber roller core having of a first configuration,
- checking the carbon fiber roller core for defects,
- turning said carbon fiber roller core to a second undersized configuration less than a desired final diameter,
- applying, taping and wrapping a carbon fiber tape a layer incorporating an epoxy therein with at least one of heating and compressing, onto the carbon fiber roller core outer surface,
- said epoxy functioning at a temperature of at least as high as 275° F.,
- subjecting the carbon fiber roller core with said carbon fiber tape and said high temperature epoxy layer thereon to a temperature no higher than a temperature of approximately 260° F. to receive said nylon coating without thermally damaging either the carbon fiber tape, epoxy, and carbon fiber roller core,
- spraying a plume of thermal powdered nylon in the form of a spray onto the carbon fiber tape and epoxy layer core with a thermal spraying apparatus,
- melting the powdered nylon at about 310° F. to 320° F. when spraying the melted nylon onto the roller,
- monitoring the locale where the applying the nylon in a form of a thermal spray to the carbon fiber roller core occurs, using one or more pyrometers upstream and/or downstream of the locale of application of the thermal nylon spray,
- finishing the nylon coating on the carbon fiber roller core to the desired diameter for use in said printing press, and
- never exposing the nylon coating therein, epoxy tape layer therein and the carbon fiber roller core, after assembled, to a temperature greater than approximately 260° F.

5. The method of claim 3, wherein the step of applying the intermediate coating comprises the step of taping a layer incorporating epoxy therein onto the carbon fiber roller core outer surface.

6. The method of claim 3, wherein the step of spraying of the core is by applying a plume of thermal nylon spray with a thermal spray apparatus.

7. The method of claim 3, wherein the step of heating the carbon fiber roller is to no higher than a temperature of approximately 260° F.

8. The method of claim 3, wherein the steps of: turning comprises reducing the carbon fiber roller core to a diameter less than a final diameter, forming an epoxy tape layer on the core by heating and/or compressing, supplying a plume of thermal nylon spray to the taped core with a thermal spray apparatus, keeping the carbon fiber roller and epoxy tape layer thereon to a temperature about 260"F or less, monitoring the temperature about the locale where the step of applying the nylon thermal spray to the carbon fiber roller core is occurring, and using one or more pyrometers upstream and/or downstream to monitor the locale of application of the thermal nylon spray.

9. The method of claim 3, comprising bonding the nylon coating and the carbon fiber roller core with a bond equal to or greater than the 1500 lbs per $in^2$.

10. The method as in claim 3, including melting the nylon at about 310° F. to 320° F. before spraying the melted nylon.

11. The method of claim 5, wherein the step of taping includes using and wrapping an epoxy carbon fiber tape layer onto the carbon fiber roller core.

12. The method of claim 6, including the step of monitoring about the locale where the step of applying the nylon thermal spray to the carbon fiber roller core occurs.

13. The method as in claim 7, comprising bonding the nylon coating and the carbon fiber roller core to a bond approximately or greater than 1,600 lbs per $in^2$.

14. The method of claim 8, wherein the step of applying a plume of thermal nylon spray includes spraying a powdered nylon coating sprayed by a thermal spraying apparatus onto an outer surface of the epoxy tape layer.

15. The method of claim 11, wherein the step of taping includes engaging the epoxy tape to the carbon fiber roller core with at least one of heating and compressing.

16. The method of claim 12, wherein the step of monitoring is using one or more pyrometers upstream and/or downstream of the locale of application of the thermal nylon spray.

17. The method of claim 14, including the step of never exposing the nylon coating, epoxy tape layer and the fiber roller core, after assembled, to a temperature greater than approximately 275° F.

18. The method of claim 16, wherein the step of monitoring occurs at both the upstream and the downstream locales.

19. The method of claim 17, including never exposing the completed nylon coating, epoxy tape layer and the fiber roller core to a temperature of greater than 260° F.

20. The method of claim 17, wherein the step of spraying a nylon coating comprises spraying a plume produced by a thermal spraying apparatus onto an epoxy covered core which is maintained at a temperature of equal or less than approximately 275° F.

* * * * *